US008225726B1

(12) United States Patent
Fineberg

(10) Patent No.: US 8,225,726 B1
(45) Date of Patent: Jul. 24, 2012

(54) PERSONAL TABLE

(75) Inventor: Sumner M. Fineberg, Jamestown, NC (US)

(73) Assignee: Suru Designs, LLC, Jamestown, NC (US)

( * ) Notice: Subject to any disclaimer, the term of this patent is extended or adjusted under 35 U.S.C. 154(b) by 255 days.

(21) Appl. No.: 12/546,014

(22) Filed: Aug. 24, 2009

Related U.S. Application Data

(63) Continuation-in-part of application No. 29/322,936, filed on Aug. 14, 2008, now Pat. No. Des. 598,677.

(51) Int. Cl.
*A47B 13/00* (2006.01)
*A47B 91/00* (2006.01)
*A47B 3/00* (2006.01)

(52) U.S. Cl. ..... 108/158.12; 108/115

(58) Field of Classification Search ..... 108/115–135, 108/150, 153.1–158.13
See application file for complete search history.

(56) References Cited

U.S. PATENT DOCUMENTS 1,940,117 A * 12/1933 Carpos ..... 108/157.18
2,000,915 A * 5/1935 Blake ..... 108/159
2,150,397 A * 3/1939 Owen ..... 108/8
2,456,964 A * 12/1948 Ledure ..... 211/33
3,338,189 A * 8/1967 Xavier ..... 108/183
3,490,601 A * 1/1970 Warn, Sr. et al. ..... 312/248
5,357,699 A * 10/1994 Padawer ..... 38/102
5,644,995 A * 7/1997 Gurwell et al. ..... 108/188
7,631,605 B2 * 12/2009 Willy ..... 108/157.16
2010/0224107 A1 * 9/2010 Aldred et al. ..... 108/129

* cited by examiner

*Primary Examiner* — Darnell Jayne
*Assistant Examiner* — Timothy M Ayres

(57) ABSTRACT

A personal table for writing, maintaining a portable computer or otherwise. The table is relatively light in weight and can be readily assembled in minutes by an unskilled person without the use of tools. The table includes a table top and a stanchion formed by slideably engaging a pair of legs. A latch at the distal ends of the legs is used to secure the legs in place and finger tabs mounted on the base beneath the table top are used to maintain the stanchion to the base. Each leg includes a pair of opposing feet, one of the feet being elongated for positioning beneath a sofa or chair to help stabilize the table during use while the other foot is truncated.

9 Claims, 5 Drawing Sheets

PERSONAL TABLE

This is a continuation-in-part of and claims benefits under pending prior patent application Ser. No. 29/322,936 filed 14 Aug. 2008, now U.S. Design Pat. No. D,598,677.

FIELD OF THE INVENTION

The invention herein pertains to small tables and particularly pertains to a small compact table which can be placed beside a chair, sofa or the like for use in writing or maintaining a laptop computer, TV dinner, notebook or other similar articles.

DESCRIPTION OF THE PRIOR ART AND OBJECTIVES OF THE INVENTION

In recent years it has become increasingly important to maintain useful articles near a chair or sofa while watching television or enjoying video games. Small personal tables are used for this purpose and are also handy such as when eating in a den or living room, or while using a portable computer. Large tables are difficult to conveniently position and usual small "end" tables are often shaky and unstable. In view of the participation in various indoor activities, the need for a small personal table which can be manually carried, easily maneuvered and which requires very little space is apparent.

Therefore, in view of the needs and expectations of current consumers the present invention was conceived and one of its objectives is to provide a small, lightweight personal table which can be easily moved from location to location throughout a house, apartment or other dwelling.

It is also an objective of the present invention to provide a personal table which is very stable in use such as when writing or maintaining a portable computer.

It is still another objective of the present invention to provide a personal table having a stanchion which supports the table top which can be secured thereto by a latch during use and which can quickly be unlatched for storage purposes.

It is yet another objective of the present invention to provide a personal table having a pair of slideable legs which form the stanchion and which separate and attach in parallel relation by magnets during non-use or storage.

Various other objectives and advantages of the present invention will become apparent to those skilled in the art as a more detailed description is set forth below.

SUMMARY OF THE INVENTION

The aforesaid and other objectives are realized by providing a small personal table which is light in weight for easy movement and placement as needed. The personal table may serve as an end table for a sofa in one instance and be moved to the front of the sofa to act as a stand for a laptop computer. The top of the table rests on a stanchion formed by a pair of legs each of which contain an elongated slot. One of the legs is rotatably attached to the table top. The table legs are slideably joined and are slid together during assembly by allowing the slots of each leg to engage the other in a secure, interlocking manner. Once the legs are so joined to form the stanchion, the distal ends of the legs are coplanar and a rotatable latch affixed to one of the distal ends of the legs is rotated to engage indents formed in the other leg to hold the legs in a secure, stable, perpendicularly fixed position. The table legs also each include an elongated foot and a truncated foot which when joined are ninety degrees (90°) apart. The elongated feet can be inserted under the edge of a chair or sofa having a low floor clearance to provide stability in the event the table is accidentally bumped. The truncated feet provide a small "footprint" for the table thereby lessening the hazard of striking the table while walking or maneuvering therearound.

A recess is provided in the underneath area of the table top for compact storage of the leg rotatably attached to the top. To disassemble the table, the legs are unlatched and the second or free leg is slideably disengaged from the first leg. The hinged leg is then folded into the recess. Next the free leg is positioned over the folded hinged leg in a parallel posture where it is so held in place by magnets. In use, the free leg is removed manually from its storage or parallel position, the rotatable leg is extended or rotated into a perpendicular configuration with the table top and the legs are then slid together in perpendicular, interlocking fashion and are latched to form the stanchion. After use, the legs are unlatched and can be slid apart and stored as described above.

DETAILED DESCRIPTION OF THE PREFERRED EMBODIMENT AND OPERATION OF THE INVENTION

Figure 1:
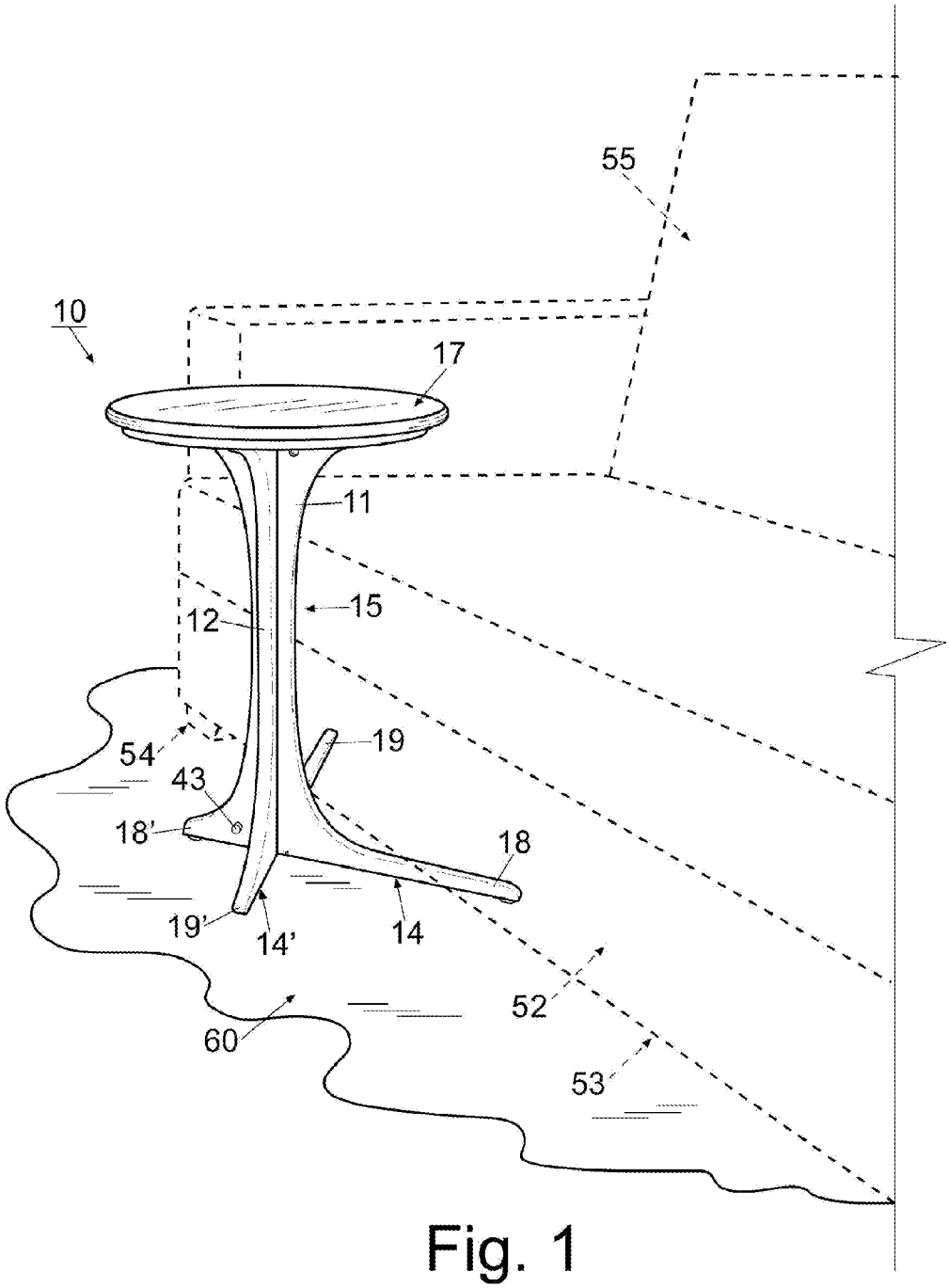
FIG. 1 demonstrates the personal table of the invention as positioned at the front of a typical imaginary sofa for the purpose of illustrating usual environment.

For a better understanding of the invention and its operation, turning now to the drawings, FIG. 1 shows preferred table 10 placed on floor 60 of a typical house, apartment or the like with elongated feet 18, 19 of respectively legs 11, 12 positioned beneath conventional sofa 55 for stability reasons. Sofa 55 includes legs 54 (only one shown) and base 52 having lower edge 53. Legs 11, 12 are slideably interlocked to form stanchion 15 with legs 11, 12 perpendicular (FIG. 3) to each other. As illustrated, distal ends 14, 14' respectively of legs 11, 12 are coplanar to firmly support table 10 on floor 60. Leg 11 includes elongated foot 18 and truncated foot 18' whereas leg 12 includes elongated foot 19 and truncated foot 19'.

Figure 2:
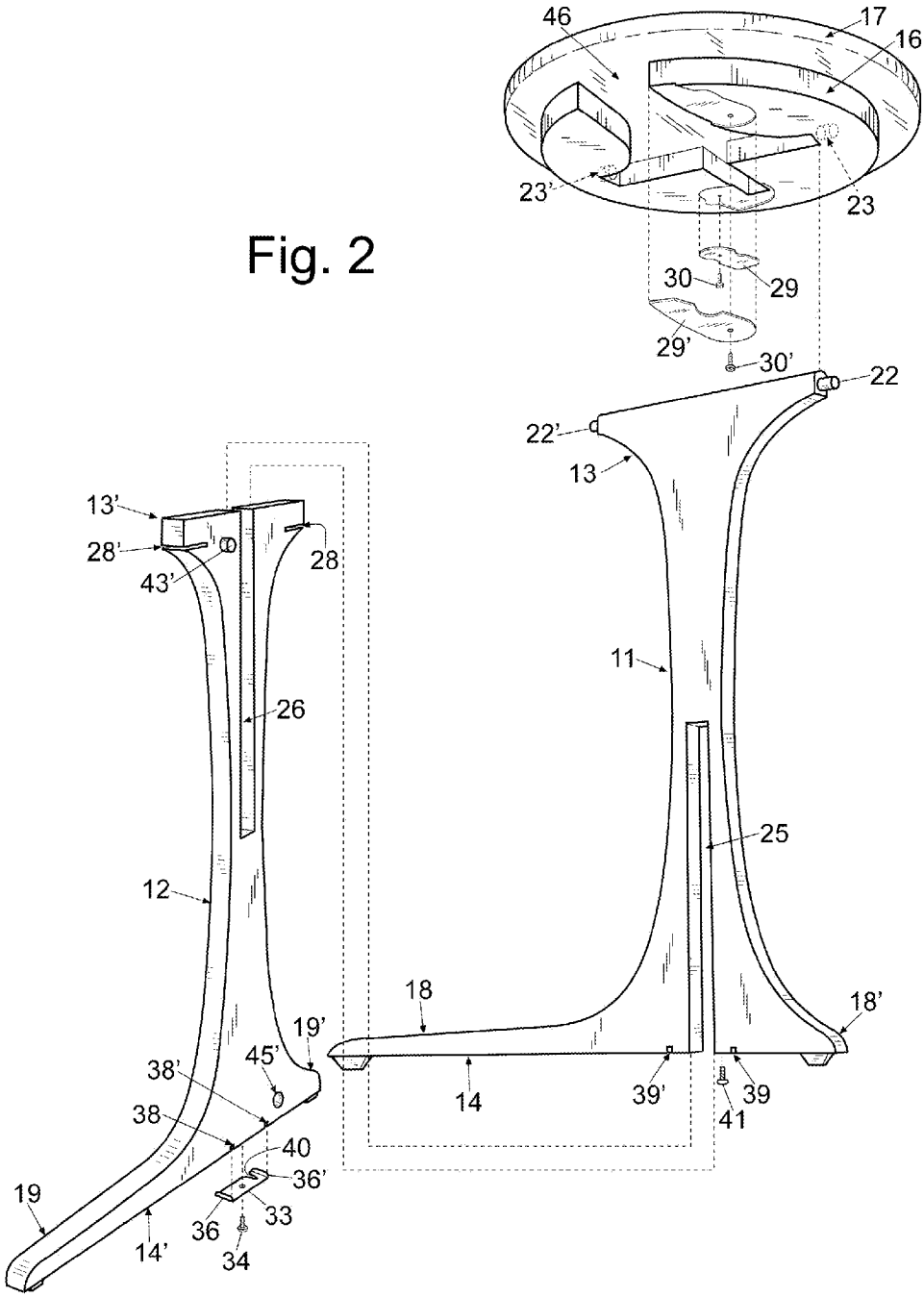
FIG. 2 shows an exploded view of the table as seen in FIG. 1.
Figure 4:
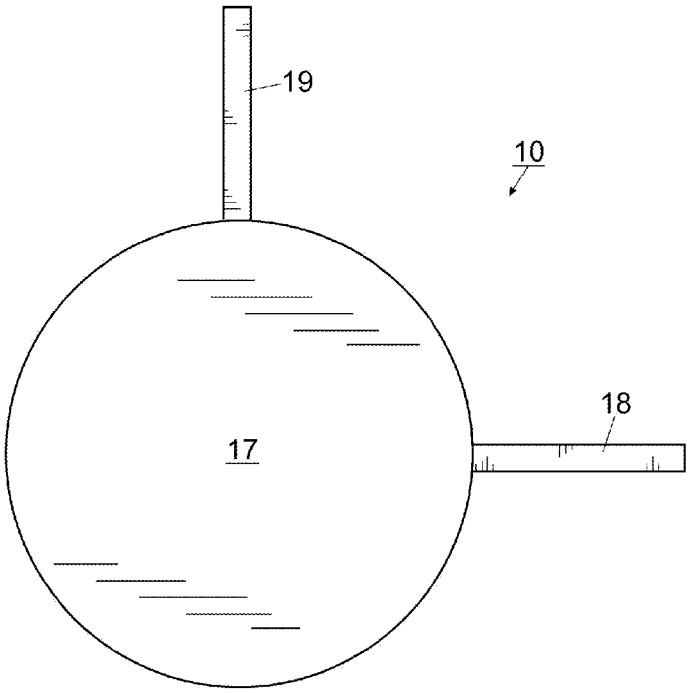
FIG. 4 illustrates a top view of the table as seen in FIG. 1 as removed from the sofa.
Figure 5:
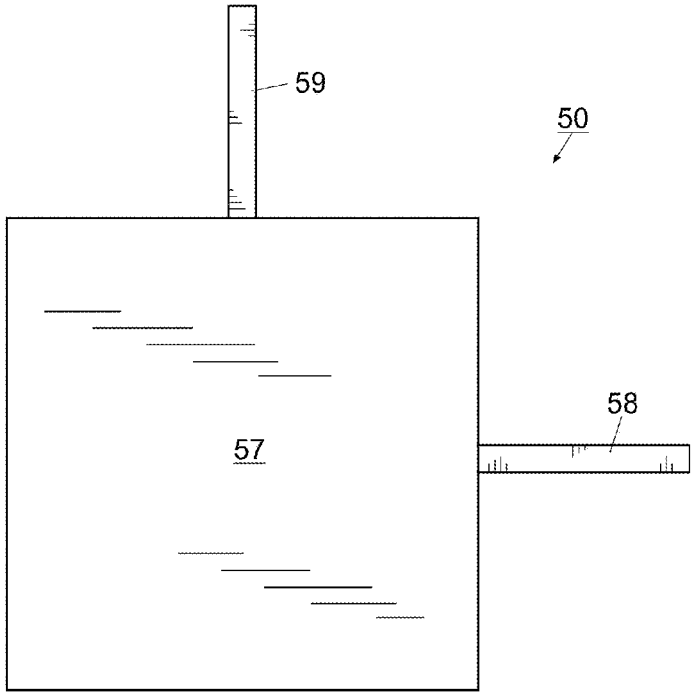
FIG. 5 depicts an alternate embodiment of the table as seen in FIG. 4.

FIG. 4 illustrates a top view of table 10 having table top 17 with a circular or round configuration. Elongated feet 18, 19 are respectively joined to legs 11, 12 as also shown in FIG. 2 and extend beyond table top 17. In FIG. 5 a top view of table 50 is seen which is an alternate embodiment. Table 50 is shown with elongated feet 58, 59 which also extend beyond rectangular top 57. As would be understood the table top could be formed in a variety of designs such as for example a hexagon or triangle shape.

Figure 3:
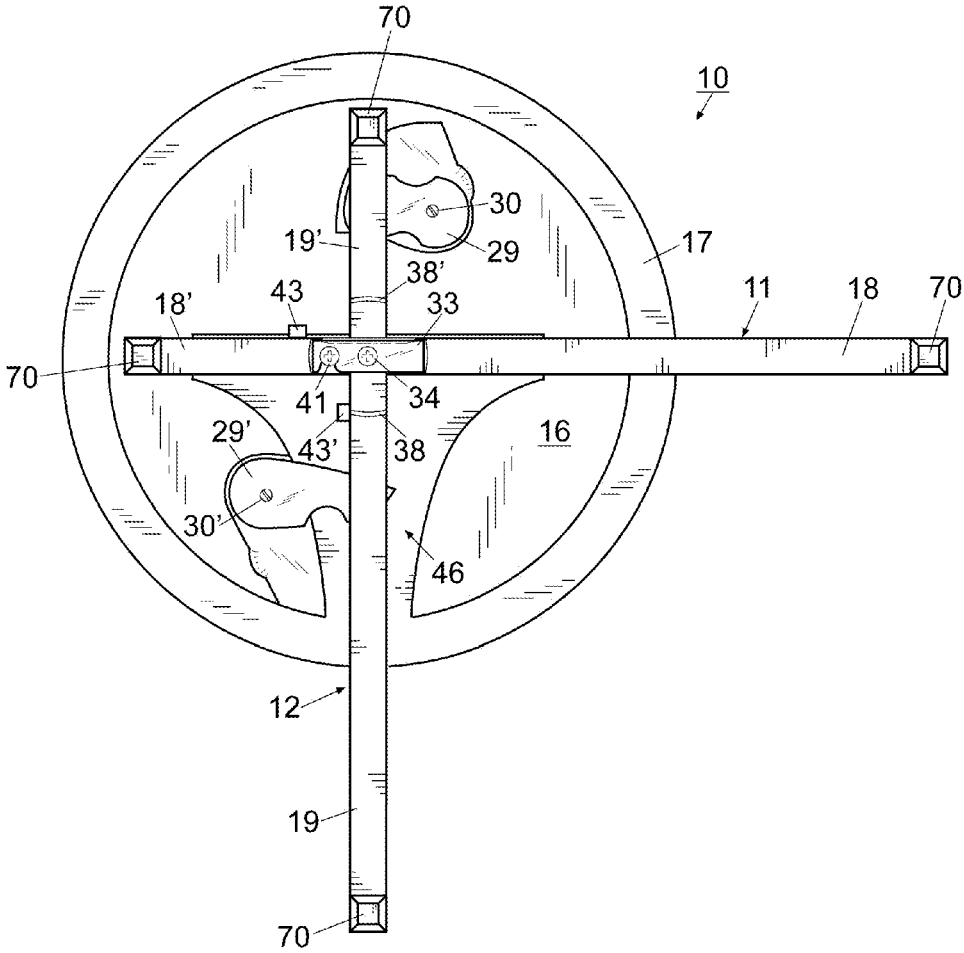
FIG. 3 pictures a bottom view of the table as seen in FIG. 1.
Figure 6:
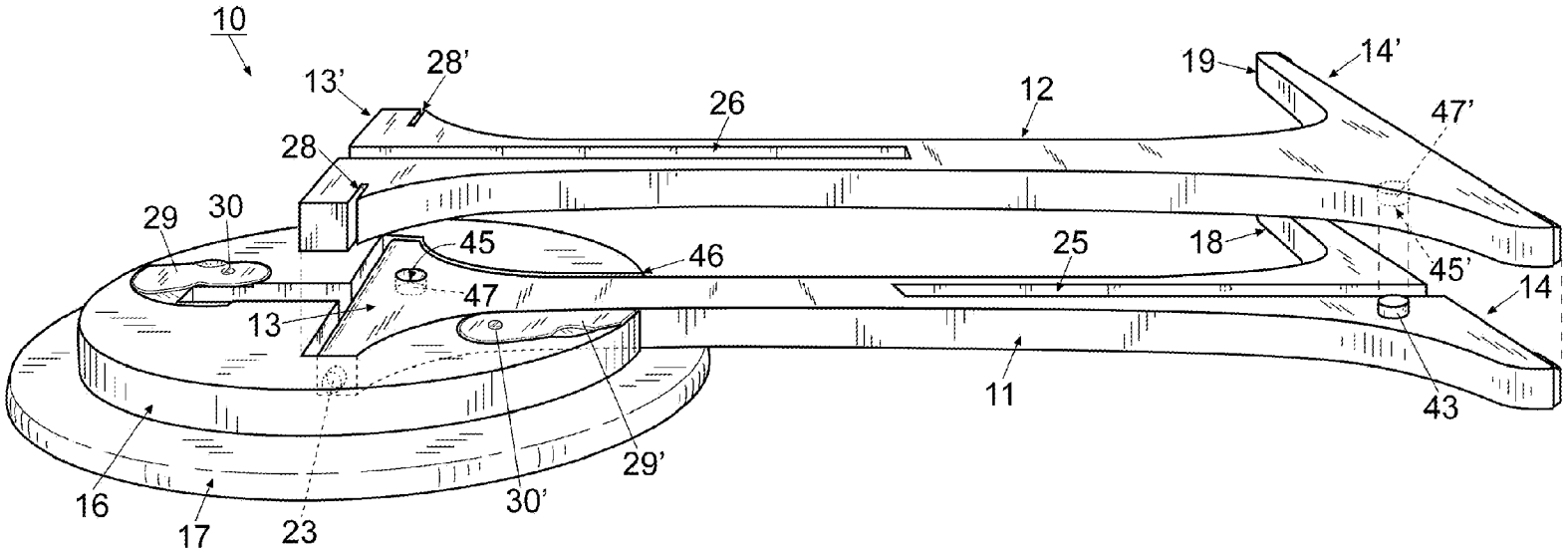
FIG. 6 features the table of FIG. 1 in a closed posture for storage purposes with the free leg exploded to better illustrate the means for attaching it during non-use.

Table 10 is easily assembled for use by a home owner or other inexperienced person and can be easily disassembled for compact storage. As seen in FIG. 2, leg 11 includes distal end 14, elongated foot 18, truncated foot 18', ferromagnetic pin 43 (FIG. 6), longitudinal slot 25, proximal end 13, axles 22, 22' and channel 45 with magnet 47 (FIG. 6) contained therein. Leg 12 includes distal end 14', elongated foot 19, truncated foot 19', channel 45' with magnet 47' contained therein (FIG. 6), longitudinal slot 26, proximal end 13', notches 28, 28' and ferromagnetic pin 43'. Table top 17 includes base 16 having recess 46 formed therein with channels 23, 23' for respectively receiving axles 22, 22' of leg 11. Recess 46 is sized to receive and maintain proximal end 13 of leg 11 therein for storage purposes as seen in FIG. 6. Recess 46 is also sized to receive perpendicularly interlocked legs 11, 12 when table 10 is assembled as seen in FIG. 3. Finger tabs 29, 29' are rotatably mounted within base 16 of table top 17 by respectively screws 30, 30' and can be manually turned to engage respectively notches 28, 28' of leg 12 for assembly as described in more detail below.

Leg 11 as shown in FIG. 1 is pivotably mounted on axles 22, 22' which fit within cylindrical channels 23, 23', also shown in dashed lines in FIG. 2. As shown in FIG. 2, longitudinal slot of leg 12 engages longitudinal slot 25 of leg 11 upon assembly and as aforementioned, distal ends 14, 14' become coplanar. Notches 28, 28' in proximal end 13' of leg 12 receive rotatable finger tabs 29, 29' which are affixed to table top 17 as also shown in FIGS. 3 and 6. Typical wood screws 30, 30' allow finger tabs 29, 29' to rotate and engage respectively notches 28, 28' in leg 12 as illustrated in FIG. 3 to maintain stanchion 15 formed by interlocking legs 11, 12 into firm engagement with table top 17. As also seen in FIG. 3 each foot 18, 18', 19 and 19' includes a rubber or synthetic stay 70 which assists in preventing scuff marks as might occur during sliding movement of table 10 if no protection were provided.

Rotatable latch 33 having flanges 36, 36' and notch 40 therein seen in FIG. 2 is affixed to distal end 14 of leg 12 by typical wood screw 34. Flanges 36, 36' are seated respectively in indents 38, 38' of leg 12 during non-use. In use after assembly of stanchion 15, latch 33 is manually turned ninety degrees (90°) allowing flanges 36, 36' to disengage indents 38, 38' in leg 12 and to engage respectively indents 39, 39' in leg 11 while notch 40 formed in latch 33 engages screw 41 which extends slightly from distal end 14 of leg 11. Thus with finger tabs 29, 29' lodged respectively in notches 28, 28' and with latch 33 residing in indents 39, 39' of leg 11, stanchion 15 is stabilized and secured to table top 17 so table 10 can be used for a variety of purposes such as for example: a small work table, dinner table or other wise as needed. Table 50 is likewise assembled for such usage.

Elongated feet 18, 19 of respectively legs 11, 12 are longer than opposing truncated feet 18', 19' as feet 18, 19 extend beyond table top 17 and beneath edge 53 of base 52 to prevent table 10 from accidentally toppling, should it be inadvertently contacted as may occur. Also harsh usage such as while playing video games may require ultimate stability. Truncated feet 18', 19' are shorter and provide a small footprint for avoiding hazards of extending legs.

After use table 10 can be compactly disassembled for storage or transport by manually rotating fingers tabs 29, 29' to release table top 17 from leg 12. Latch 33 is likewise rotated to unlatch leg 12 from leg 11 to allow slideable release of leg 12 from leg 11 through disengagement of slots 25, 26. Once legs 11, 12 are disengaged, hinged leg 11 is pivoted or rotated ninety degrees (90°) on axles 22, 22' (FIG. 2) and folded into recess 46 of base 16 on the underside of top 17 as seen in FIG. 6. Free leg 12 is then positioned atop leg 11 whereby ferromagnetic pin 43 on distal end 14 of leg 11 engages magnet 47' contained within channel 45' on distal end 14' of leg 12. Also, opposingly positioned ferromagnetic pin 43' on proximal end 13' of leg 12 engages magnet 47 contained within channel 45 on proximal end 13 of leg 11. Ferromagnetic pins 43, 43' attach to magnets 47, 47' respectively to join legs 11, 12 in compact, parallel relation for storage purposes.

After storage, table 10 can be reassembled by urging leg 12 by slight hand pressure to detach leg 12 from leg 11. Thereafter, hinged leg 11 is rotated about axles 22, 22' to an upright position perpendicular to table top 17 as seen in FIG. 2. With leg 11 upright, slot 26 of leg 12 can then be fully directed through slot 25 of leg 11 to form stanchion 15. With stanchion 15 so formed, finger tabs 29, 29' are manually rotated to engage respectively notches 28, 28' in leg 12 to secure table top 17, insuring table top 17 remains in perpendicular fashion with stanchion 15 while in use. Lastly latch 33 is rotated for securement as described above to complete the assembly. Table 10 can then be used as an accessory table or used in conjunction with a chair or sofa for additional stability and convenience.

The illustrations and examples provided herein are for explanatory purposes and are not intended to limit the scope of the appended claims.

I claim:

1. A table in combination with other furniture, the other furniture having a low floor clearance, the table comprising: a first leg, a second leg, each of said legs defining a slot, said first leg slot engaging said second leg slot to form a stanchion, a table top, said table top mounted on said stanchion, a pair of identically shaped elongated feet, each of said pair of elongated feet affixed to different ones of said legs, each of said pair of elongated feet extending beyond said table top, said elongated feet positioned below said other furniture for stability purposes, a pair of truncated feet, each of said pair of truncated feet affixed to different ones of said legs, each of said pair of truncated feet extending within said table top, each of said pair of truncated feet adjacently positioned to different ones of said pair of elongated feet.

2. The combination of claim 1 wherein each of said legs have proximal and distal ends, said first leg slot defined in said proximal end, said second leg slot defined in said distal end.

3. The combination of claim 1 wherein said second leg slot engages said first leg slot to allow said legs to be perpendicularly engaged.

4. The combination of claim 1 wherein each of said leg slots extend about one half the length of each of said legs.

5. The combination of claim 1 further comprising a latch, said latch affixed to one of said legs, said latch for maintaining said legs in an engaged posture.

6. The combination of claim 1 wherein said table top is rectangular.

7. The combination of claim 1 wherein said table top is circular.

8. A table in combination with a furniture item for placement on the floor:

a) said table comprising: a first leg, a second leg, each of said legs defining a slot, said first leg slot engaging said second leg slot to form a stanchion, a table top, said table top mounted on said stanchion, a pair of identically shaped elongated feet, each of said pair of elongated feet affixed to different ones of said legs, each of said pair of elongated feet extending beyond said table top, a pair of identically shaped truncated feet, each of said pair of truncated feet affixed to different ones of said legs, each of said pair of truncated feet extending within said table top, each of said pair of truncated feet adjacently positioned to different ones of said pair of elongated feet;

b) said furniture item comprising: a base, a furniture leg, said furniture leg attached to said base, said base defining an edge; and c) said elongated feet positioned on the floor beneath said furniture base edge to maintain said table in a stable position.

9. The table of claim 8 wherein said furniture item comprises a sofa.

* * * * *